US008826971B2

(12) United States Patent
Xiangxun et al.

(10) Patent No.: US 8,826,971 B2
(45) Date of Patent: Sep. 9, 2014

(54) MICRO-CHANNEL HEAT EXCHANGER

(75) Inventors: Lu Xiangxun, Zhejiang (CN); Lin-jie Huang, East Amherst, NY (US)

(73) Assignees: Danfoss Sanhua (Hangzhou) Micro, Zhejiang (CN); Channel Heat exchanger Co., Ltd.

( * ) Notice: Subject to any disclaimer, the term of this patent is extended or adjusted under 35 U.S.C. 154(b) by 931 days.

(21) Appl. No.: 12/755,700

(22) Filed: Apr. 7, 2010

(65) Prior Publication Data

US 2010/0252242 A1 Oct. 7, 2010

(30) Foreign Application Priority Data

Apr. 7, 2009 (CN) ..... 2009 1 0132690

(51) Int. Cl.

| | |
|---|---|
| ***F28D 7/08*** | (2006.01) |
| ***F28F 9/02*** | (2006.01) |
| ***F28D 1/053*** | (2006.01) |
| ***F28F 9/16*** | (2006.01) |
| ***F25B 39/04*** | (2006.01) |
| *F28F 9/04* | (2006.01) |

(52) U.S. Cl.

CPC ..... *F28D 1/05391* (2013.01); *F28F 2275/06* (2013.01); *F28F 9/0246* (2013.01); *F25B 2339/044* (2013.01); *F28F 9/16* (2013.01); *F28F 9/0209* (2013.01); *F25B 39/04* (2013.01)

USPC ..... 165/176; 165/178

(58) Field of Classification Search

CPC ..... F28D 1/05375; F28D 1/05383; F28D 1/05325; F28D 1/05333; F28D 1/05341; F28D 1/06; F28D 1/05308; F28D 1/05316; F28D 1/05358; F28D 1/05366; F28F 9/0246; F28F 2250/06

USPC ..... 165/174, 175, 176, 177, 178

See application file for complete search history.

(56) References Cited

U.S. PATENT DOCUMENTS 4,679,410 A * 7/1987 Drayer ..... 62/503
5,141,048 A * 8/1992 Sausner ..... 165/110

(Continued)

FOREIGN PATENT DOCUMENTS

EP 1410929 A2 4/2004
GB 362781 12/1931

(Continued)

OTHER PUBLICATIONS

European Search Report for EP 10 00 3412 dated Nov. 29, 2013.

*Primary Examiner* — Tho V Duong
(74) *Attorney, Agent, or Firm* — McCormick, Paulding & Huber LLP

(57) ABSTRACT

There is disclosed a micro-channel heat exchanger, comprising a first header formed with an inlet; a second header spaced apart from the first header, one of the first and second headers being formed with an outlet; flat tubes, two ends of each flat tube being connected with the first and second headers respectively such that a plurality of micro-channels of each flat tube communicate with the first and second headers; fins, each fin being disposed between two adjacent flat tubes; and a return pipe, a first end of which being connected to the outlet formed in one of the first and second headers and a second end thereof being extended towards the other of the first and second headers. The location of the outlet of the micro-channel heat exchanger is easy to change, and the micro-channel heat exchanger is low in cost, compact in structure and easy to install.

9 Claims, 5 Drawing Sheets

(56) References Cited

U.S. PATENT DOCUMENTS

| | | | | |
|---|---|---|---|---|
| 5,186,248 | A * | 2/1993 | Halstead | 165/173 |
| 5,400,853 | A * | 3/1995 | Wolters | 165/137 |
| 5,752,566 | A * | 5/1998 | Liu et al. | 165/110 |
| 6,494,059 | B2 * | 12/2002 | Yamazaki et al. | 62/509 |
| 7,093,461 | B2 * | 8/2006 | Patel et al. | 62/512 |
| 2002/0046571 | A1 * | 4/2002 | Bernini | 62/474 |
| 2005/0056402 | A1 | 3/2005 | Han et al. | |
| 2006/0032626 | A1 | 2/2006 | Keen | |
| 2006/0090879 | A1 | 5/2006 | Han | |
| 2006/0144076 | A1 * | 7/2006 | Daddis et al. | 62/440 |

FOREIGN PATENT DOCUMENTS

| | | | |
|---|---|---|---|
| JP | 09053866 | | 2/1997 |
| JP | 09053866 | A * | 2/1997 |
| JP | 09053867 | | 2/1997 |
| JP | 11211277 | A * | 8/1999 |
| WO | 2006083484 | A1 | 8/2006 |
| WO | 2008/060270 | A1 | 5/2008 |

* cited by examiner

MICRO-CHANNEL HEAT EXCHANGER

CROSS REFERENCE TO RELATED APPLICATIONS

This application is entitled to the benefit of and incorporates by reference essential subject matter disclosed in Chinese Patent Application No. 200910132690.5 filed on Apr. 7, 2009.

BACKGROUND OF THE INVENTION

1. Field of the Invention

The present invention generally relates to a heat exchanger, more particularly, to a micro-channel heat exchanger.

2. Description of the Related Art

The micro-channel heat exchanger is used for heat exchanging. For example the micro-channel heat exchanger may be used as a condenser or an evaporator in a refrigeration system and generally comprises headers, flat tubes formed with micro channels, and fins disposed between two adjacent flat tubes. The micro-channel heat exchanger may comprise a plurality of flow paths, when the number of the flow paths is even, the outlet and inlet of the micro-channel heat exchanger are formed in the same header, and when the number of the flow paths is odd, the outlet and inlet of the micro-channel heat exchanger are formed in two opposite headers respectively.

According to the size and operating condition of the micro-channel heat exchanger, in order to optimize the heat transfer performance, both the micro-channel heat exchanger having an odd number of flow paths and the micro-channel heat exchanger having an even number of flow paths are widely used. The location of the outlet of the micro-channel heat exchanger having an odd number of flow paths is different from that of the outlet of the micro-channel heat exchanger having an even number of flow paths, which makes the installation of the micro-channel heat exchanger and design of the packing case therefore difficult. For example, with the micro-channel heat exchanger having an odd number of flow paths, the outlet and inlet thereof may be required to be formed at the same side; with the micro-channel heat exchanger having an even number of flow paths, the outlet and inlet thereof may be required to be formed at opposite sides. The conventional micro-channel heat exchanger can not meet the above requirements, so that it is difficult to install the micro-channel heat exchanger, thus decreasing the work efficiency.

In addition, when the micro-channel heat exchanger is used as condenser, the required amount of the refrigerant is different according to the operating condition. The conventional micro-channel heat exchanger cannot adjust the refrigerant amount in the circuit of the refrigeration system, so that the operation of the refrigeration system is not stable.

SUMMARY OF THE INVENTION

The present invention is directed to solve at least one of the problems existing in the prior art. Accordingly, a micro-channel heat exchanger is provided, where the location of the outlet of the micro-channel heat exchanger is easy to change. For example, the outlet and inlet of the micro-channel heat exchanger having an odd number of flow paths can be formed at the same side, and the outlet and inlet of the micro-channel heat exchanger having an even number of flow paths can be formed at two opposite sides.

According to an embodiment of the present invention, there is provided a micro-channel heat exchanger, comprising: a first header formed with an inlet; a second header spaced apart from the first header by a predetermined distance, in which one of the first and second headers is formed with an outlet; flat tubes, in which two ends of each flat tube are connected with the first and second headers respectively such that a plurality of micro-channels of each flat tube communicate with the first and second headers; fins, in which each fin is disposed between two adjacent flat tubes; and a return pipe, a first end of which is connected to the outlet formed in one of the first and second headers and a second end of which is extended towards the other of the first and second headers.

According to embodiments of the present invention, the location of the outlet of the micro-channel heat exchanger is easy to change as desired via the return pipe, so that the installation of the micro-channel heat exchanger and the design of the case for packing the micro-channel heat exchanger are facilitated.

According to embodiments of the present invention, when the micro-channel heat exchanger is used as a condenser in a refrigeration system, the return pipe can be further used as a container for storing refrigerant, and there are following advantageous effects: liquid slugging is prevented; leakage loss of the refrigerant in the refrigeration system may be compensated; the refrigeration system is balanced; the refrigerant may have a predetermined degree of supercooling before entering the evaporator of the refrigeration system; if the operating condition is changed, the refrigerant charge needs to be adjusted, or the refrigerant circulation is changed, the container for storing refrigerant can stabilize the refrigerant circulation. In addition, the container can store refrigerant when the refrigeration system needs to be repaired, so as to reduce waste and pollution. The micro-channel heat exchanger is more compact in structure and tidy in appearance.

The above summary of the present invention is not intended to describe each disclosed embodiment or every implementation of the present invention. The Figures and the detailed description which follow more particularly exemplify illustrative embodiments.

BRIEF DESCRIPTION OF THE DRAWINGS

These and other aspects and advantages of the invention will become apparent and more readily appreciated from the following descriptions taken in conjunction with the drawings, in which.

Figure 1:
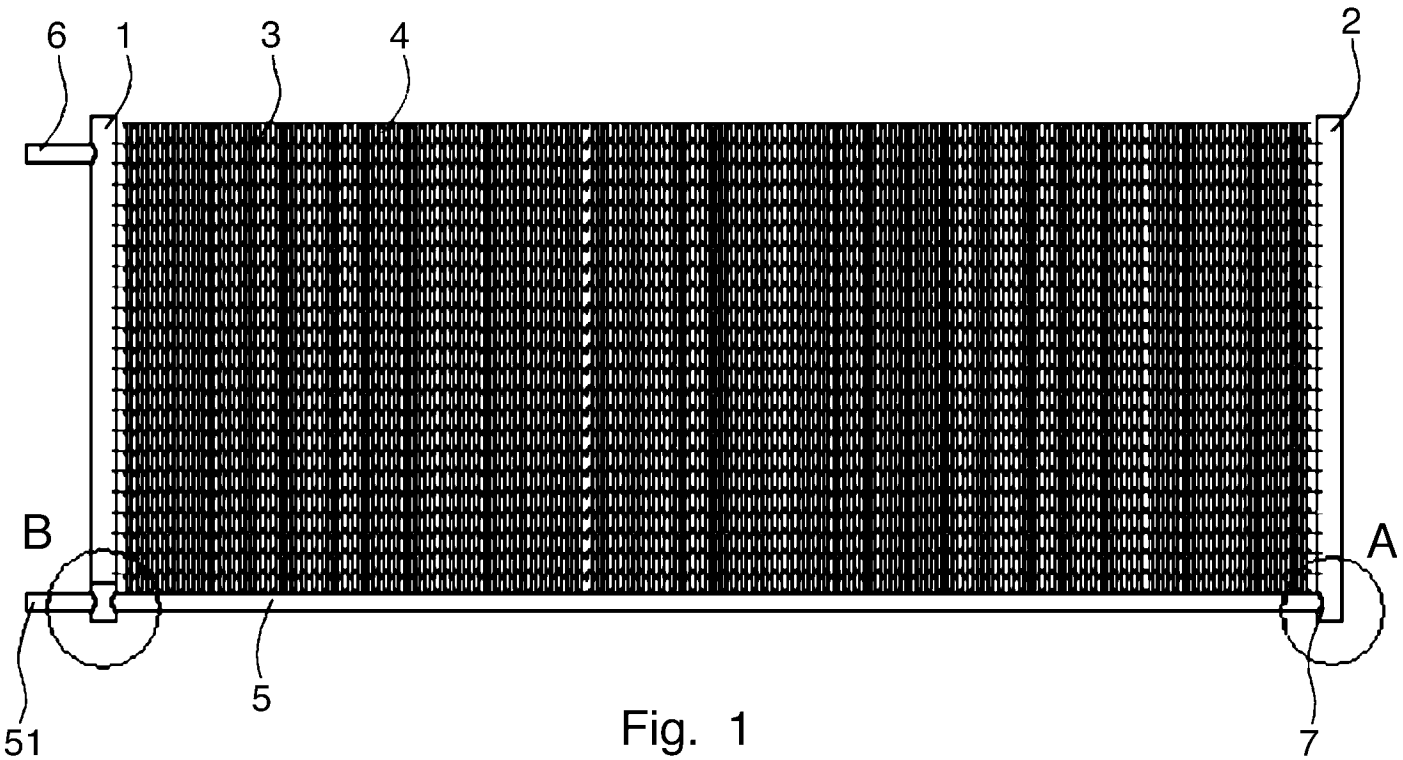
FIG. 1 is a schematic view of the micro-channel heat exchanger according to an embodiment of the present invention.
Figure 7:
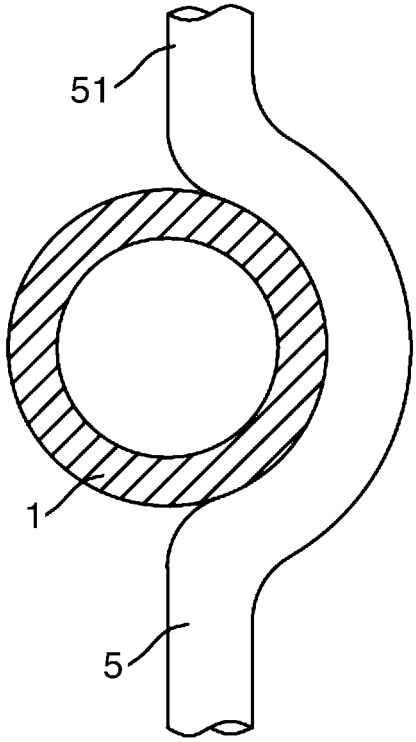
Figure 8:
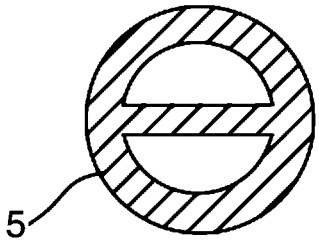
Figure 9:
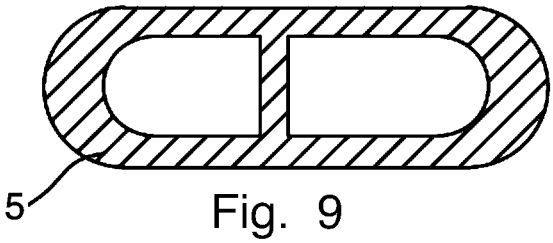
Figure 10:
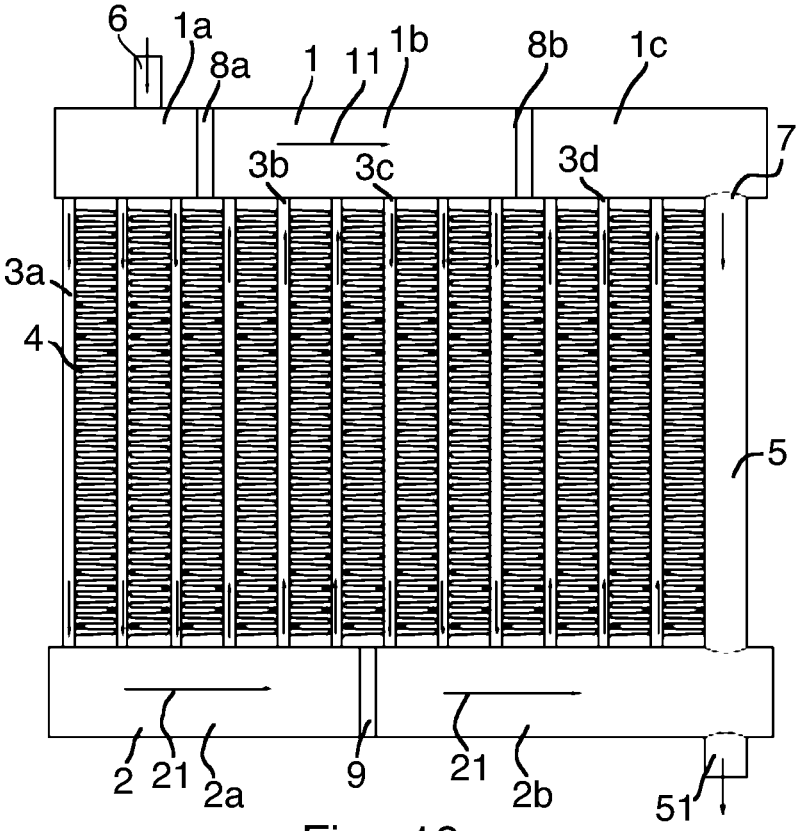

FIG. 7 is an enlarged section view of a portion of the micro-channel heat exchanger indicated by circle B in FIG. 1 according to still another embodiment of the present invention, in which the second end of the return pipe by-passing through the first header is enlarged;

FIG. 8 is a schematic cross-section view of the return pipe according to an embodiment of the present invention;

FIG. 9 is a schematic cross-section view of the return pipe according to another embodiment of the present invention; and FIG. 10 is a schematic view of the micro-channel heat exchanger having four flow paths according to an embodiment of the present invention, in which two partition plates are disposed in the first header and one partition plate in the second header.

DETAILED DESCRIPTION OF EMBODIMENTS OF THE INVENTION

Reference will be made in detail to embodiments of the present invention. The embodiments described herein with reference to drawings are explanatory, illustrative, and used to generally understand the present invention. The embodiments shall not be construed to limit the present invention. The same or similar elements and the elements having same or similar functions are denoted by like reference numerals throughout the descriptions.

In the description, terms such as "first", "second" are used for convenience of description and cannot be constructed to limit the present invention.

Figure 2:
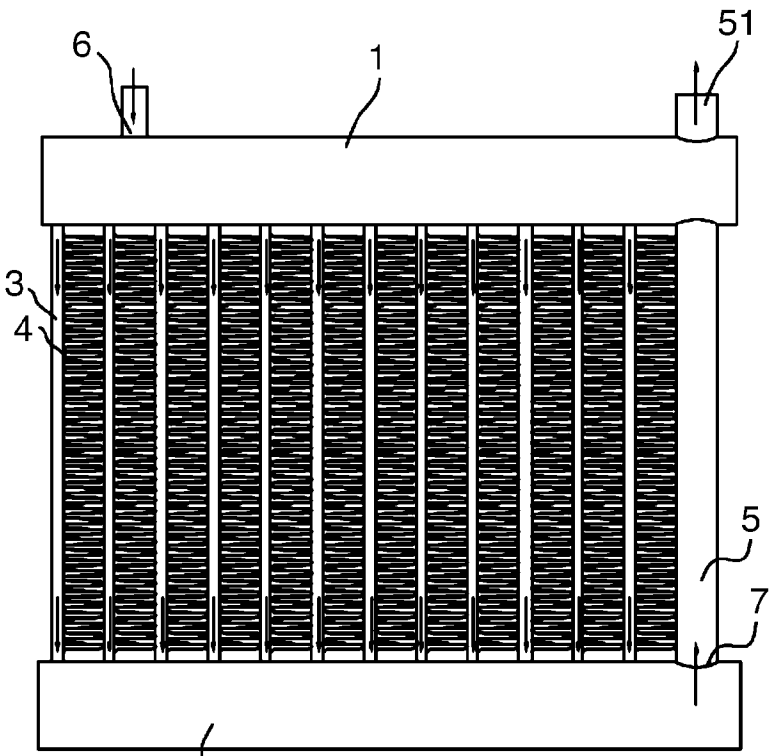
FIG. 2 is a schematic view of the micro-channel heat exchanger having one flow path according to an embodiment of the present invention.

As shown in FIGS. 1 and 2, the micro-channel heat exchanger according to an embodiment of the present invention comprises a first header 1, a second header 2, flat tubes 3, fins 4 and a return pipe 5.

In FIG. 1, the first header 1 is located at the left side and the second header 2 is located at the right side. In FIG. 2, the first header 1 is located at the upper side and the second header 2 is located at the lower side. The first header 1 is substantially parallel to and spaced apart by a predetermined distance from the second header 2. It should be noted that the embodiments shown in the above figures are only exemplified and the present invention is not limited to this.

The first header is formed with an inlet 6. In FIGS. 1 and 2, a length of inlet pipe is connected to the inlet 6, and the inlet pipe may have different forms and sizes. Here, inlet and inlet pipe have the same meaning. As indicated by the arrows in FIG. 2, a fluid such as liquid or gaseous refrigerant may enter the first header 1 via the inlet 6. In other words, the fluid enters the micro-channel heat exchanger via the inlet 6.

As described above, the first header 1 is substantially parallel to and spaced apart by a predetermined distance from the second header 2. The predetermined distance may be selected as desired. In examples shown in FIGS. 1 and 2, the micro-channel heat exchanger has one flow path.

Here, the term "flow path" is a path along which the fluid in the flat tube flows in one direction from one header to another header (FIG. 2 shows a micro-channel heat exchanger having one flow path). When the micro-channel heat exchanger has a plurality of flow paths, two adjacent flow paths are connected in series via a connection flow path (for example, the connection flow paths 21 or 11 in FIG. 3) in one header, and the flowing directions of the fluid in two adjacent flow paths are substantially opposed to each other. It should be noted that one flow path may comprise a plurality of flat tubes and the flowing directions of the fluid in the plurality of flat tubes of one flow path are substantially identical.

Figure 3:
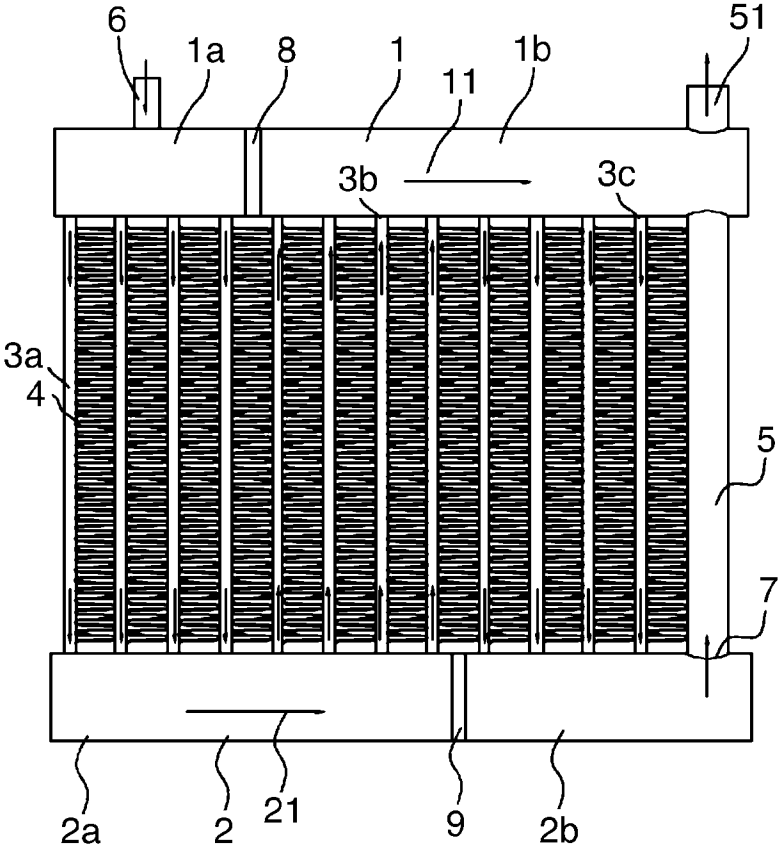
FIG. 3 is a schematic view of the micro-channel heat exchanger having three flow paths according to an embodiment of the present invention, in which the first and second headers are provided with one partition plate therein respectively.

For example, as shown in FIG. 3, in the micro-channel heat exchanger having three flow paths, the fluid flows in four flat tubes 3 downwardly from the first header 1 to the second header 2 (the first flow path); then the fluid changes its direction via a connection flow path 21 in the second header 2 so as to flow in four flat tubes 3 upwardly from the second header 2 to the first header 1 (the second flow path). The first flow path and the second flow path are connected in series via the connection flow path 21 in the second header 2. Finally, the fluid changes its direction via a connection flow path 11 in the first header 1 so as to flow in four flat tubes 3 downwardly from the first header 1 to the second header 2 (the third flow path). The third flow path and the second flow path are connected in series via the connection flow path 11 in the first header 1.

Since the micro-channel heat exchanger has an odd number of flow paths such as one flow path shown in FIGS. 1 and 2 or three flow paths shown in FIG. 3, the outlet of the micro-channel heat exchanger is formed in the second header 2, that is, the outlet 7 and the inlet 6 are not formed in the same one header.

Both ends of each flat tube 3 are connected with the first header 1 and the second header 2 such that the plurality of micro channels of each flat tube 3 communicate with the first header 1 and the second header 2. Therefore, the fluid enters the first header 1 via the inlet 6, and then flows to the second header 2 via the micro channels of the flat tubes 3. Finally the fluid is discharged from the second header 2. When the fluid flows through the flat tubes 3, the fluid exchanges heat with the external environment.

Fins 4 used for transferring heat are disposed between adjacent flat tubes 3 respectively. For example, the fins 4 may be welded to the flat tubes 3.

As described above, when the micro-channel heat exchanger has an odd number of flow paths, the inlet 6 is formed in the first header 1 and the outlet 7 is formed in the second header 2. In other words, the inlet 6 and the outlet 7 are not located at the same side of the micro-channel heat exchanger.

In use, for example, installation space or the pipe to be connected to the outlet may requires the inlet 6 and the outlet 7 to be located at the same side (such as left side in FIG. 1 or upper side in FIG. 2) of the micro-channel heat exchanger. Accordingly, the first end of the return pipe 5 is connected to the outlet 7 formed in the second header 2 and the second end thereof is extended towards the first header 1. That is, the second end 51 of the return pipe 5 is extended to the side at which the first header 1 is located, so that the second end 51 of the return pipe 5 becomes the outlet of the micro-channel heat exchanger for discharging the fluid from the micro-channel heat exchanger. In other words, the return pipe 5 shifts the outlet of the micro-channel heat exchanger to the side at which the inlet 6 is located. That is, the second end 51 of the return pipe 5 serves the function of the outlet 7, so that the inlet and outlet of the micro-channel heat exchanger are located at the same side such as the left side in FIG. 1 and the upper side of the FIG. 2. Therefore, even if the installation space of the pipe to be connected to the outlet requires the inlet 6 and the outlet 7 to be located at the same side, the micro-channel heat exchanger can be installed conveniently.

As shown in FIGS. 1 and 2, in some embodiments of the present invention, the second end 51 of the return pipe 5 is extended from the second header 2 to the first header 1 along the outermost side of the micro-channel heat exchanger and goes beyond the first header 1. Here, term "outermost side"

means the outermost side of the micro-channel heat exchanger in the lateral direction (the upper and lower direction in FIG. 1, the left and right direction in FIG. 2).

Figure 4:
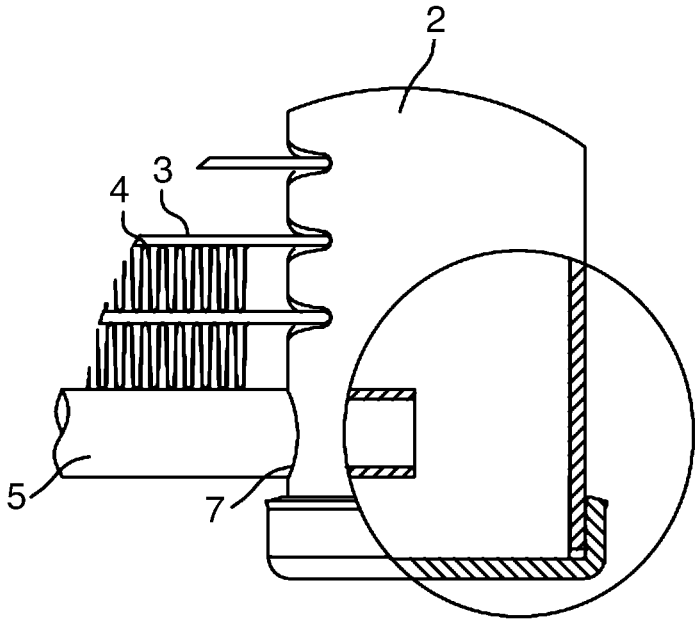
FIG. 4 is an enlarged schematic view of a portion of the micro-channel heat exchanger indicated by circle A in FIG. 1.
Figure 5:
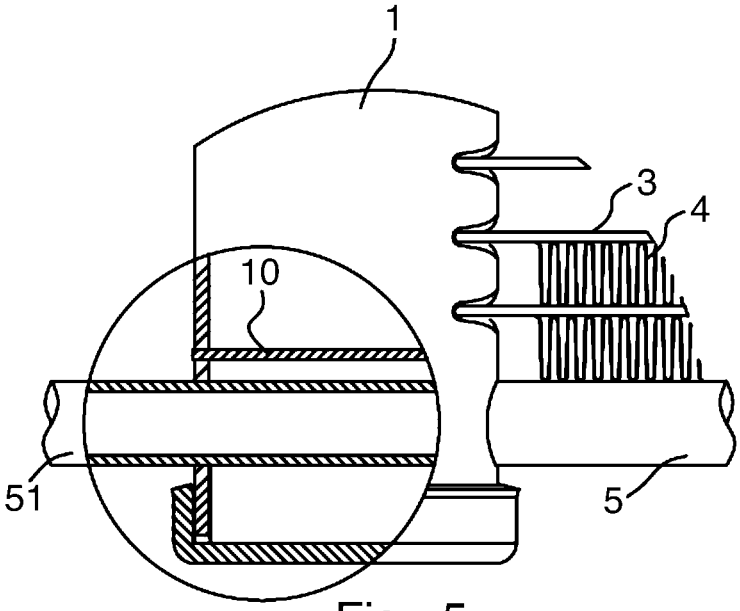
FIG. 5 is an enlarged schematic view of a portion of the micro-channel heat exchanger indicated by circle B in FIG. 1 according to one embodiment of the present invention.

FIG. 4 is an enlarged schematic view of a portion of the micro-channel heat exchanger indicated by circle A in FIG. 1. As shown in FIG. 4, the first end of the return pipe 5 is extended into the second header 2 and may be welded to the second header 2. In some embodiments of the present invention, FIG. 5 is an enlarged schematic view of a portion of the micro-channel heat exchanger indicated by circle B in FIG. 1. As shown in FIG. 5, the second end of the return pipe 5 is extended in the radial direction of the first header 1 and passes through the first header 1. The second end of the return pipe 5 may be not welded to the first header 1, so that the flatulence due to heat and shrink of the return pipe 5 will not bring disadvantageous effects to the micro-channel heat exchanger. In addition, in the first header 1, a seal plate 10 is disposed between the return pipe 5 and an outermost flat tube 3 adjacent to the return pipe 5, so as to prevent the fluid from leaking.

The phrase "pass through" means that the second end of the return pipe 5 may penetrate through (as shown in FIG. 5) or by-pass the first header 1 (as shown in FIG. 7). The return pipe 5 may be connected to the first header 1 by using a clip.

Figure 6:
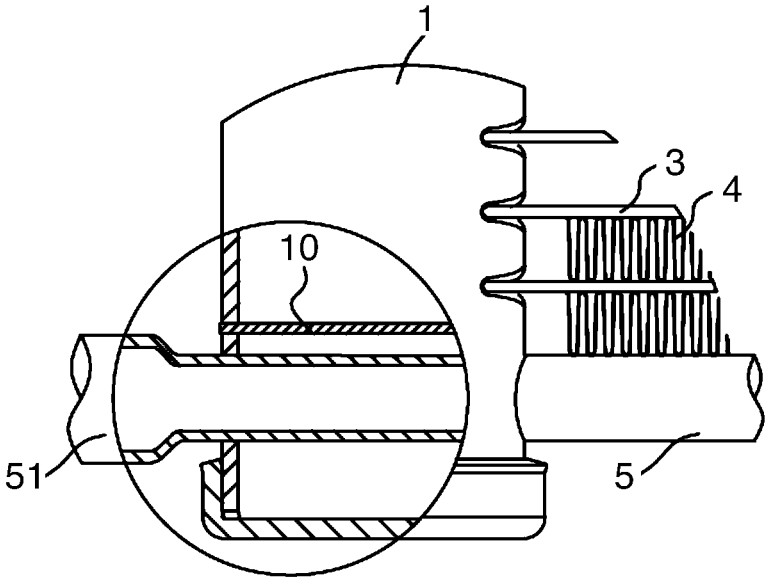
FIG. 6 is an enlarged schematic view of a portion of the micro-channel heat exchanger indicated by circle B in FIG. 1 according to another embodiment of the present invention, in which the second end of the return pipe passing through the first header is enlarged.

In some embodiments of the present invention, as shown in FIG. 6, the second end 51 of the return pipe extended out of the first header 1 is enlarged so as to connect with other pipes conveniently. As shown in FIGS. 8 and 9, the return pipe 5 may have a circular or flat cross-section, but the present invention is not limited to this, for example, the return pipe 5 may have an oval cross-section. In some embodiments of the present invention, as shown in FIGS. 8 and 9, a rib is disposed in the return pipe 5 so that the interior of the return pipe 5 is divided into two passages. Therefore, the return pipe 5 is reinforced via the rib and the heat transfer performance of the return pipe 5 is increased. In the examples shown in FIGS. 8 and 9, one rib is disposed in the return pipe 5, but the present invention is not limited to this.

In examples shown in FIGS. 1-2 and 4-6, the return pipe 5 is welded to the fin 4 located at the laterally outermost side of the micro-channel heat exchanger, such that the return pipe 5 may protect the flat tubes 3 and the fin 4, and increase the strength of the micro-channel heat exchanger.

When the micro-channel heat exchanger according to the present invention is used as a condenser in the refrigeration system, the return pipe 5 may be further used as a container for storing the refrigerant. The container for storing the refrigerant formed by the return pipe 5 can prevent liquid slugging in the refrigeration system, compensate for leaking loss of the refrigerant in the refrigeration system, maintain the balance between evaporation and condensation, cause the refrigerant to have a predetermined degree of supercooling before the refrigerant enters the evaporator of the refrigeration system, stabilize the refrigerant circulation if the operating condition is changed, the refrigerant charge needs to be adjusted, or the refrigerant circulation is changed, and store refrigerant when repairing the refrigeration system so as to reduce waste and pollution. Therefore, it is not necessary to provide a separate container for storing refrigerant so as to decrease the cost and save space, and the micro-channel heat exchanger is more compact in structure and tidy in appearance.

In examples show in FIGS. 1 and 2, the micro-channel heat exchanger has one flow path. The micro-channel heat exchanger having three flow paths according to another embodiment of the present invention will be described with reference to FIG. 3.

As shown in FIG. 3, a partition plate 8 is disposed in the first header 1 so as to divide the interior of the first header 1 into a first portion 1*a* and a second portion 1*b*. Similarly, a partition plate 9 is disposed in the second header 2 so as to divide the interior of the second header 2 into a first portion 2*a* and a second portion 2*b*.

As described above, in the micro-channel heat exchanger shown in FIG. 3, as indicated by the arrows in FIG. 3, the fluid enters the first portion 1*a* of the first header 1 via the inlet 6 of the first header 1 and flows in the flat tubes 3*a* downwards to the first portion 2*a* of the second header 2 (the first flow path). The fluid entering the first portion 2*a* of the second header 2 changes its flow direction via the connection flow path 21 in the second header 2 and flows in the flat tubes 3*b* upwards to the second portion 1*b* of the first header 1 (the second flow path). Then, the fluid entering the second portion 1*b* of the first header 1 changes its flow direction via the connection flow path 11 in the first header 1 and flows in the flat tubes 3*c* downwards to the second portion 2*b* of the second header 2 (the third flow path). Finally, the fluid enters the return pipe 5 via the outlet 7 formed in the second header 2 and is discharged via the second end 51 of the return pipe 5 extended to the side at which the first header 1 is located. Since the inlet and outlet are located at the same side of the micro-channel heat exchanger, it is advantageous to install the micro-channel heat exchanger and design the case for packing the micro-channel heat exchanger. The other structures of the micro-channel heat exchanger shown in FIG. 3 may be identical with those of the micro-channel heat exchangers shown in FIGS. 1 and 2, so that their detailed descriptions are omitted here.

By changing the number of the partition plates 8 and 9 disposed in the first header 1 and the second header 2, the micro-channel heat exchanger may have 5, 7 or 9 flow paths.

A micro-channel heat exchanger having an even number of flow paths according to an embodiment of the present invention will be described below. For example, the micro-channel heat exchanger shown in FIG. 10 has four flow paths. As shown in FIG. 10, two partition plates 8*a*, 8*b* are disposed in the first header 1 so as to divide the interior of the first header 1 into a first portion 1*a*, a second portion 1*b* and a third portion 1*c*. One partition plate 9 is disposed in the second header 2 so as to divide the interior of the second header 2 into a first portion 2*a* and a second portion 2*b*.

As indicated by the arrows in FIG. 10, the fluid enters the first portion 1*a* of the first header 1 via the inlet 6 of the first header 1 and flows in the flat tubes 3*a* downwards to the first portion 2*a* of the second header 2 (the first flow path). The fluid entering the first portion 2*a* of the second header 2 changes its flow direction via the connection flow path 21 in the second header 2 and flows in the flat tubes 3*b* upwards to the second portion 1*b* of the first header 1 (the second flow path). Then, the fluid entering the second portion 1*b* of the first header 1 changes its flow direction via the connection flow path 11 in the first header 1 and flows in the flat tubes 3*c* downwards to the second portion 2*b* of the second header 2 (the third flow path). Next, the fluid entering the second portion 2*b* of the second header 2 changes its flow direction via the connection flow path 21 and flows in the flat tubes 3 upwards to the third portion 1*c* of the first header 1 (the fourth flow path). Finally, the fluid enters the return pipe 5 via the outlet 7 formed in the first header 1 and is discharged via the second end 51 of the return pipe 5 extended to the side at which the second header 2 is located. Therefore, the inlet and outlet of the micro-channel heat exchanger having four flow paths can be located at two opposite sides, such that the requirements for the micro-channel heat exchanger having an even number of flow paths and the inlet and outlet thereof being located at two opposite sides can be satisfied.

It is known from the above descriptions with reference to FIGS. 3 and 10 that: in the flow paths of the micro-channel heat exchanger, the flow directions of the fluid in the odd numbered flow paths (such as the first flow path, the third flow paths) are substantially identical with each other, the flow directions of the fluid in the even numbered flow paths (such as the second flow path, the fourth flow paths) are substantially identical with each other and opposite to those of the fluid in the odd numbered flow paths, and two adjacent flow paths are connected in series via a connection flow path in one header.

In the example shown in FIG. 10, the micro-channel heat exchanger has four flow paths. A person skilled in the art may understand that the micro-channel heat exchanger may have two or more than four flow paths.

The other structures of the micro-channel heat exchanger having an even number of flow paths may be similar to those of the micro-channel heat exchanger having an odd number of flow paths shown in FIGS. 2 and 3, for example, the first end of the return pipe 5 may be extended into the first header 1 and welded thereto. The second end of the return pipe 5 may pass through the second header 2, and the seal plate 10 may be disposed between the return pipe 5 and the outermost flat tube 3 in the second header 2. In addition, the return pipe 5 may be welded to the outermost fin 4 so as to protect the fin 4 and the flat tube 3 and increase the strength of the micro-channel heat exchanger. When the micro-channel heat exchanger shown in FIG. 10 is used as condenser, the return pipe 5 can be further used as a container for storing fluid, the advantages and effects thereof having been described above.

Therefore, with the micro-channel heat exchanger according to the embodiments of the present invention, the location of the outlet in the micro-channel heat exchanger can be changed as desired, so that the applicability of the micro-channel heat exchanger is high, the installation of the micro-channel heat exchanger is easy, and the design of the case for packing the micro-channel heat exchanger is facilitated. The return pipe 5 can change the location of the outlet of the micro-channel heat exchanger, protect the fins and the flat tubes so as to increase the overall strength of the flatulence due to heat and shrink of the return pipe will not bring disadvantageous effects to the micro-channel heat exchanger. When the micro-channel heat exchanger is used as a condenser in the refrigeration system, the return pipe can be further used as a container for storing fluid, so that the operation of the refrigeration system is more stable, and the micro-channel heat exchanger is lower in manufacturing cost, compact in structure and tidy in appearance.

Although explanatory embodiments have been shown and described, it would be appreciated by those skilled in the art that changes, alternatives, and modifications can be made in the embodiments without departing from the spirit and principles of the invention. Such changes, alternatives, and modifications all fall into the scope of the claims and their equivalents.

What is claimed is:

1. A micro-channel heat exchanger, comprising:

a first header formed with an inlet;

a second header spaced apart from the first header by a predetermined distance, in which one of the first and second headers is formed with an outlet;

flat tubes, in which two ends of each flat tube are connected with the first and second headers respectively such that a plurality of micro-channels of each flat tube communicate with the first and second headers;

fins, in which each fin is disposed between two adjacent flat tubes; and a return pipe, a first end of which is connected to the outlet formed in one of the first and second headers and a second end thereof is extended towards the other of the first and second headers;

wherein the second end of the return pipe passes through the first or second header by by-passing the first or second header so that the return pipe is formed around a portion of the first or second header being by-passed and conforms to the shape thereof.

2. The micro-channel heat exchanger according to claim 1, wherein the return pipe is extended along an outermost side of the micro-channel heat exchanger.

3. The micro-channel heat exchanger according to claim 2, wherein the return pipe is welded to an outermost fin adjacent to the return pipe.

4. The micro-channel heat exchanger according to claim 1, wherein the micro-channel heat exchanger comprises an odd number of flow paths and the outlet is formed in the second header.

5. The micro-channel heat exchanger according to claim 4, wherein partition plates are disposed in the first and second headers respectively such that the micro-channel heat exchanger comprises at least three flow paths.

6. The micro-channel heat exchanger according to claim 1, wherein the micro-channel heat exchanger comprises an even number of flow paths and the outlet is formed in the first header.

7. The micro-channel heat exchanger according to claim 6, wherein partition plates are disposed in the first and second headers respectively such that the micro-channel heat exchanger comprises at least four flow paths.

8. The micro-channel heat exchanger according to claim 1, wherein the micro-channel heat exchanger is used as a condenser and the return pipe can be further used as a container for storing a fluid.

9. The micro-channel heat exchanger according to claim 1, wherein at least one rib is disposed in the return pipe therein such that interior of the return pipe is divided into at least two passages.

* * * * *

UNITED STATES PATENT AND TRADEMARK OFFICE

CERTIFICATE OF CORRECTION

PATENT NO. : 8,826,971 B2
APPLICATION NO. : 12/755700
DATED : September 9, 2014
INVENTOR(S) : Lu Xiangxun et al.

It is certified that error appears in the above-identified patent and that said Letters Patent is hereby corrected as shown below:

On the title page item 73 please correct the Assignee listed on the patent, namely, Danfoss Sanhua (Hangzhou) Micro Channel Heat Exchanger Co., Ltd., Zhejiang (CN)

To read

Sanhua Holding Group Co. Ltd., Zhejiang (CN); and
Danfoss A/S Nordborg (DK)

Signed and Sealed this
First Day of March, 2016

Michelle K. Lee

Michelle K. Lee
*Director of the United States Patent and Trademark Office*